United States Patent [19]

Ammenheuser et al.

[11] Patent Number: 4,914,482

[45] Date of Patent: Apr. 3, 1990

[54] SHEET TRANSPORT SYSTEM

[75] Inventors: Herbert H. Ammenheuser, Henrietta; Joseph Fantuzzo, Webster, both of N.Y.

[73] Assignee: Xerox Corporation, Stamford, Conn.

[21] Appl. No.: 306,116

[22] Filed: Feb. 6, 1989

[51] Int. Cl.[4] ..... G03G 15/00

[52] U.S. Cl. ..... 355/271; 355/277; 355/312

[58] Field of Search ..... 355/271, 277, 312; 271/94, 96, 5, 3.1

[56] References Cited

U.S. PATENT DOCUMENTS

| | | | |
|---|---|---|---|
| 3,547,535 | 12/1970 | McLean et al. | 355/49 |
| 3,677,643 | 7/1972 | Sagawa | 355/91 |
| 4,421,306 | 12/1983 | Muka | 271/5 |
| 4,550,999 | 11/1985 | Anderson | 355/37 TR |
| 4,552,448 | 11/1985 | Davidson | 355/3 SH |
| 4,589,768 | 5/1986 | Iwata et al. | 355/312 X |
| 4,605,298 | 8/1986 | Russel et al. | 355/271 |
| 4,687,323 | 8/1987 | Fujii | 355/73 |
| 4,703,923 | 11/1987 | Anderson et al. | 271/3.1 |
| 4,739,361 | 4/1988 | Roy et al. | 355/3 DR |
| 4,740,813 | 4/1988 | Roy | 355/3 DR |
| 4,786,938 | 11/1988 | Carter | 355/271 |
| 4,809,033 | 2/1989 | Ikemoto et al. | 355/271 |

*Primary Examiner*—A. C. Prescott

*Attorney, Agent, or Firm*—H. Fleischer; J. E. Beck; R. Zibelli

[57] ABSTRACT

An apparatus which transports a sheet through a transfer station to transfer an image from an image receiving member thereto. A stationary member has at least a portion thereof positioned closely adjacent the image receiving member to define a transfer zone therebetween. A substantial portion of the sheet is vacuum tacked to the transfer member. The sheet is moved relative to the transfer member to advance through the transfer zone so that the image is transferred from the image receiving member to the sheet.

20 Claims, 9 Drawing Sheets

SHEET TRANSPORT SYSTEM

This invention relates generally to an electrophotographic printing machine, and more particularly concerns an apparatus for transporting a sheet into registration with a toner image developed on a photoconductive member.

In the process of electrophotographic printing, a photoconductive member is uniformly charged and exposed to a light image of an original document. Exposure of the photoconductive member records an electrostatic latent image corresponding to the informational areas contained within the original document. After the electrostatic latent image is recorded ono the photoconductive surface, the latent image is developed by bringing a developer material into contact therewith. This forms a powder image on the photoconductive member which is subsequently transferred to a copy sheet and permanently affixed thereto in image configuration.

Multi-color electrophotographic printing is similar to foregoing process of black and white printing. However, rather than forming a single latent image on the photoconductive surface, successive latent images corresponding to different colors are recorded thereon. Each single color electrostatic latent image is developed with toner of a color complimentary in color thereto. The latent images may be developed with a liquid or dry developer material. This process is repeated a plurality of cycles for differently colored images and their respective complementarily colored toner. Each single color toner image is transferred to the copy sheet in superimposed registration with the prior toner image. This creates a multi-layered toner image on the copy sheet. Thereafter, the multilayered toner image is permanently fused to the copy sheet creating a color copy.

Hereinbefore, the toner images have been transferred to the copy sheet by an electrical field created by a corona generating device of the type disclosed in U.S. Pat. No. 2,836,725 issued to Vyverberg in 1958. A corona generator of this type induces transfer to the copy sheet by spraying a corona discharge having a polarity opposite to that of the toner on the photoconductive surface. This causes the toner to be electrically transferred to the copy sheet. However, in transferring multiple toner images, each toner image must be in superimposed registration with one another in order to produce a color copy which is not blurred. In lieu of utilizing a corona generating device, an electrically biased transfer roll may be used. The electrically biased transfer roll generates a high voltage discharge in the proximity of the surface of the copy sheet, or it may be applied by means of a conductive cylinder in contact with the copy sheet, as disclosed in U.S. Pat. No. 2,807,233 issued to Fitch in 1957. The copy sheet is interposed between the conductive roller and the photoconductive surface. A charge of opposite polarity from the toner is deposited on the back side of the copy sheet which attracts the toner thereto. Frequently, when only the lead edge of the copy sheet is secured to the cylinder, the trail edge flips causing the toner image to be disturbed. In either case, the copy sheet must be advanced in a recirculating path and the toner images transferred in registration with one another. Various approaches have been devised to move the copy sheet in a recirculating path, the following patents appear to be relevant:

U.S. Pat. No. 3,547,535 Patentee: McLean et al. Issued: Dec. 15, 1970.

U.S. Pat. No. 3,677,643 Patentee: Sagawa Issued: July 18, 1972.

U.S. Pat. No. 4,550,999 Patentee: Anderson Issued: Nov. 5, 1985.

U.S. Pat. No. 4,552,448 Patentee: Davidson Issued: Nov. 12, 1985.

U.S. Pat. No. 4,687,323 Patentee: Fujii Issued: Aug. 18, 1987.

U.S. Pat. No. 4,739,361 Patentee: Roy et al. Issued: Apr. 19, 1988.

U.S. Pat. No. 4,740,813 Patentee: Roy Issued: Apr. 26, 1988.

The pertinent portions of the foregoing patents may be briefly summarized as follows:

U.S. Pat. No. 3,547,535 discloses a vacuum drum for use in a photocopier that holds down a document on the surface of the drum. The drum is rotatably supported on a fixed hollow shaft having ball bearing assemblies at either end. A hollow mounting drum on one end has a flow passage for a vacuum source while an annular gear wheel rotates the drum.

U.S. Pat. No. 3,677,643 describes a drum having a multiplicity of orifices on the surface with the air pressure in orifices being reduced to attract a sheet of paper to the drum surface.

U.S. Pat. No. 4,550,999 discloses a rotatable drum for use in an electrophotographic copier. The drum has a plurality of holes connected to a vacuum pump for securing a leading edge of a sheet onto the drum. The pump assembly is attached to the drum but does not rotate with it.

U.S. Pat. No. 4,552,448 describes a sheet transport which advances a sheet into registration with successive toner powder images developed on a photoconductive drum. The sheet gripper is moved in a recirculating path and a pin extending outwardly therefrom mates with a hole in the photoconductive drum to register successive toner images with one another for transfer to the copy sheet. Corona generators spray ions onto the back side of the copy sheet to attract successive toner images of different colors thereto in superimposed registration with one another to form a multi-color copy.

U.S. Pat. No. 4,687,323 discloses a rotary suction drum having a number of pores on the drum surface. The pores are in communication with the suction source by ducts. The reduced pressure on the drum in the region of the pores attacts a sheet of of paper to the drum surface.

U.S. Pat. Nos. 4,739,361 and 4,740,813 describe a transfer roller apparatus for photocopiers which have vacuum pumped orifice holes for tacking the leading edge of a document to the peripheral surface of a drum.

In accordance with one aspect of the present invention, there is provided an apparatus for transporting a sheet through a transfer station to transfer an image from an image receiving member thereto. The apparatus includes a stationary transfer member having at least a portion thereof positioned closely adjacent the image receiving member to define a transfer zone therebetween. Means are provided for vacuum tacking a substantial portion of the sheet to the transfer member. Means move the sheet relative to the transfer member to advance the sheet through the transfer zone to transfer the image from the receiving member to the sheet.

Pursuant to another aspect of the present invention, there is provided an electrophotographic printing machine of the type having a toner image developed on a moving photoconductive member with a sheet being advanced into registration with the toner image developed on the photoconductive member. A stationary transfer member has at least a portion thereof positioned closely adjacent the photoconductive member to define a transfer zone therebetween. Means are provided for vacuum tacking a substantial portion of the sheet to the transfer member. Means move the sheet relative to the transfer member to advance the sheet through the transfer zone to transfer the toner image from the photoconductive member to the sheet.

Other aspects of the present invention will become apparent as the following description proceeds and upon reference to the drawings, in which.

While the present invention will be described hereinafter in conjunction with a preferred embodiment thereof, it will be understood that it is not intended to limit the invention to this embodiment. On the contrary, it is intended to cover all alternatives, modifications and equivalents as may be included within the spirit and scope of the invention as defined by the appended claims.

Figure 1:
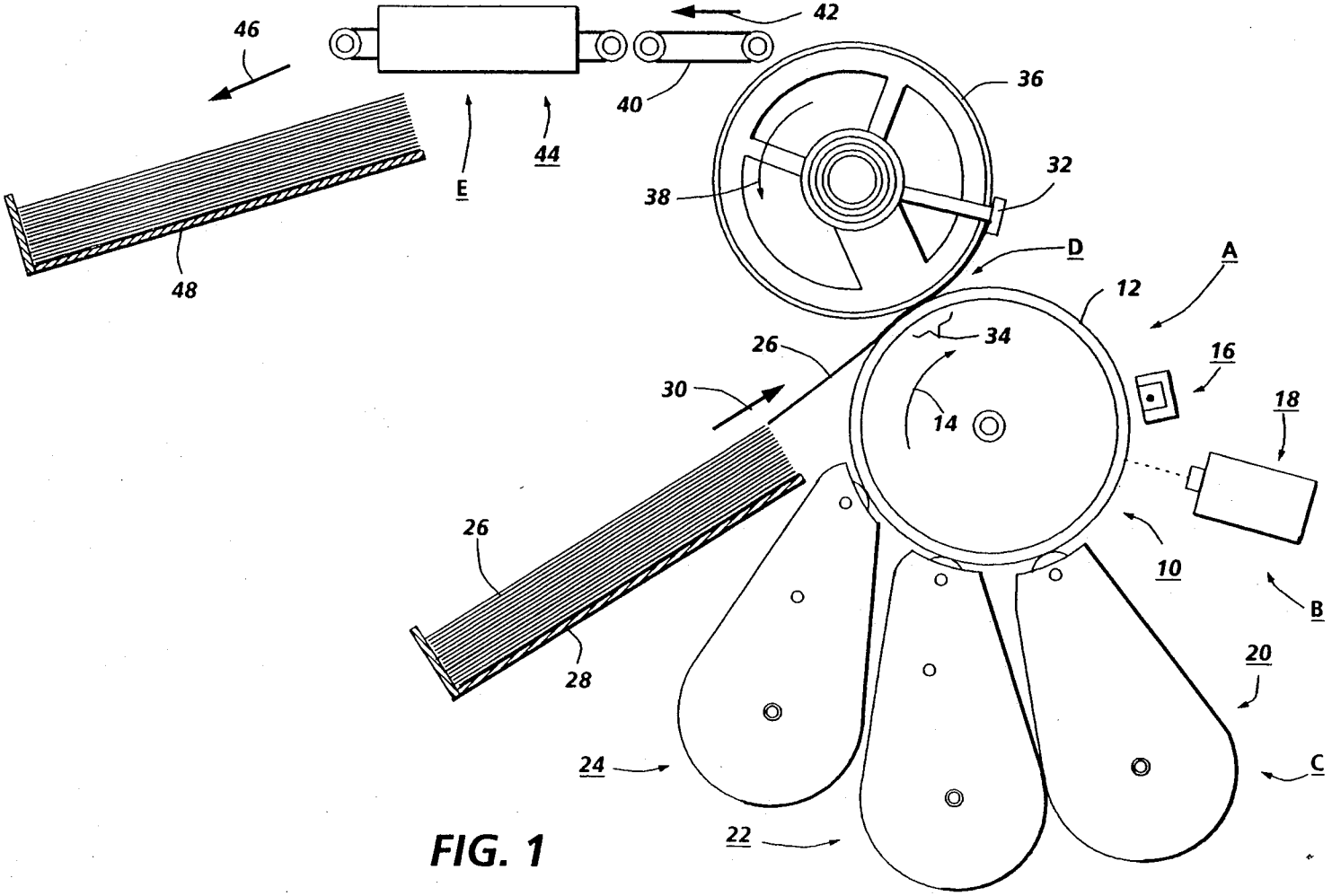
FIG. 1 is a schematic elevational view showing an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine having the sheet transport system of the present invention therein. It will become evident from the following discussion that this system is equally well suited for use in a wide variety of printing machines and is not necessarily limited in its application to the particular printing machine described herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a drum 10 having a photoconductive surface 12 adhering to a conductive substrate. Preferably, the photoconductive surface comprises a selenium alloy with the conductive substrate being an electrically grounded aluminum alloy. Drum 10 moves in the direction of arrow 14 to advance successive portions of the photoconductive surface sequentially through the various processing stations disposed about the path of movement thereof.

Initially, a portion of the photoconductive surface passes through charging station A. At charging station A, a corona generating device indicated generally by the reference numeral 16, charges the photoconductive surface to a relatively high, substantially uniform potential.

Next, the charged portion of the photoconductive surface is advanced through imaging station B. At imaging station B, a filtered light image of an original document is projected onto the charged portion of photoconductive surface 12. A moving lens system and a color filter mechanism, indicated generally by the reference numeral 18, move in a timed relationship with drum 10 to scan successive incremental areas of the original document disposed upon a transparent platen. Lamps, located beneath the platen, illuminate successive incremental areas of the original document. A suitable moving lens system is described in U.S. Pat. No. 3,062,108 issued to Mayo in 1952. Similarly, U.S. Pat. No. 3,775,006 issued to Hartman et al. in 1973 discloses a suitable filter mechanism. Finally, U.S. Pat. No. 3,592,531 issued to McCrobie in 1971 discloses a suitable type of lens. The foregoing elements cooperate with one another to produce a single color light image of the original document which is projected onto the charged portion of the photoconductive surface 12 selectively dissipating the charge thereon to record a single color electrostatic latent image. One skilled in the art will appreciate that in lieu of the foregoing optical system, a modulated beam of energy, i.e. a laser beam, or other suitable device, such as light emitting diodes, may be used to irradiate the charged portion of the photoconductive surface so as to record selected information thereon. Information from a computer may be employed to modulate the laser beam. The modulated laser beam forms a light image corresponding to one of the colors desired in the copy. Thus, the information initially recorded on the photoconductive surface by the laser beam corresponds to the information desired to be reproduced in one color. The foregoing process is repeated for each color.

After the electrostatic latent image is recorded on the photoconductive surface, drum 10 advances the electrostatic latent image to development station C. At development station C, three individual developer units, generally designated by the reference numerals 20, 22, and 24, respectively, render successive electrostatic latent images visible. A suitable development station for use in a color electrophotographic printing machine is disclosed in U.S. Pat. No. 3,854,449 issued to Davidson in 1974. Each of the developer units described therein is of a type referred to in the art as "magnetic brush developer units". In general, a magnetic brush developer unit employs a developer mix of ferromagnetic carrier granules having toner particles triboelectrically attracted thereto. This brush of developer mix is brought into contact with the latent image recorded on the photoconductive surface 12. Toner particles are attracted from the carrier granules to the latent image by the greater electrostatic force thereof. Thus, the latent image is developed or rendered visible by the toner particles. Developer units 20, 22 and 24, respectively, contain different colored toner particles. Each of the toner particles contained in the respective developer unit corresponds to the complement of the single color light image transmitted through each of the differently colored filters of the filter mechanism used in optical system 18. As an illustration, a latent image formed by a green filtered light image is developed with green absorbing magenta toner particles. Similarly, latent images formed by blue and red images are developed with yellow and cyan toner particles, respectively. If desired, a fourth developer unit having black toner particles may be used as well. One skilled in the art will appreciate that a liquid developer material may be used in lieu of the dry developer material previously described. A liquid developer material is a mixture of toner particles in a liquid carrier. The toner particles are of the appropriate color with the liquid carrier being substantially colorless.

Drum 10 then advances the toner image to transfer station D. At transfer station D, a copy sheet 26 is moved into contact with the toner image. The copy sheet may be plain paper or a sheet of thermoplastic material, amongst others. The copy sheet is advanced from a stack of copy sheets 26 disposed upon tray 28. The sheet moves in the direction of arrow 30 to transfer station D. At transfer station D, the copy sheet is secured to a rotating sheet gripper 32 which moves the sheet through transfer zone 34 about stationary transfer drum 36. Transfer drum 36 is the same diameter as photoconductive drum 10. Sheet gripper rotates, in the direction of arrow 38, at the same angular velocity as that of drum 10. Copy sheet 26 is vacuum tacked to the exterior surface of drum 34. Thus, copy sheet 26 moves in a recirculating path in synchronism with the rotation of drum so that successive electrostatic latent images may be transferred thereto. Further details of the sheet transport and transfer station will be described hereinafter with reference to FIGS. 2 through 9, inclusive. After the last toner imaged has been transferred to the copy sheet, the copy sheet advances onto conveyor 40. Conveyor 40 advances the copy sheet with the toner image adhering thereto, in the direction of arrow 42, to fusing station E.

Fusing station E includes a fuser assembly, indicated generally by the reference numeral 44, which permanently affixes the transferred toner image to the sheet. One suitable type of fusing apparatus is described in U.S. Pat. No. 3,907,492 issued to Draugelis et al. in 1975. After fusing, the copy sheet is advanced in the direction of arrow 46 to catch tray 48 for subsequent removal from the printing machine by the operator.

After the image is transferred from the photoconductive surface to the copy sheet, drum 10 rotates the photoconductive surface to a cleaning station (not shown). At the cleaning station, a pre-clean corona generating device neutralizes the charge on the photoconductive surface and that of the residual toner particles. This enables a fibrous brush in contact with the photoconductive surface to remove the residual particles adhering to the photoconductive surface. A suitable brush cleaning system is described in U.S. Pat. No. 3,590,412 issued to Gerbasi in 1971.

It is believed that the foregoing description is sufficient for purposes of the present invention to illustration the general operation of an electrophotographic printing machine incorporating the features of the present invention therein.

Figure 2:
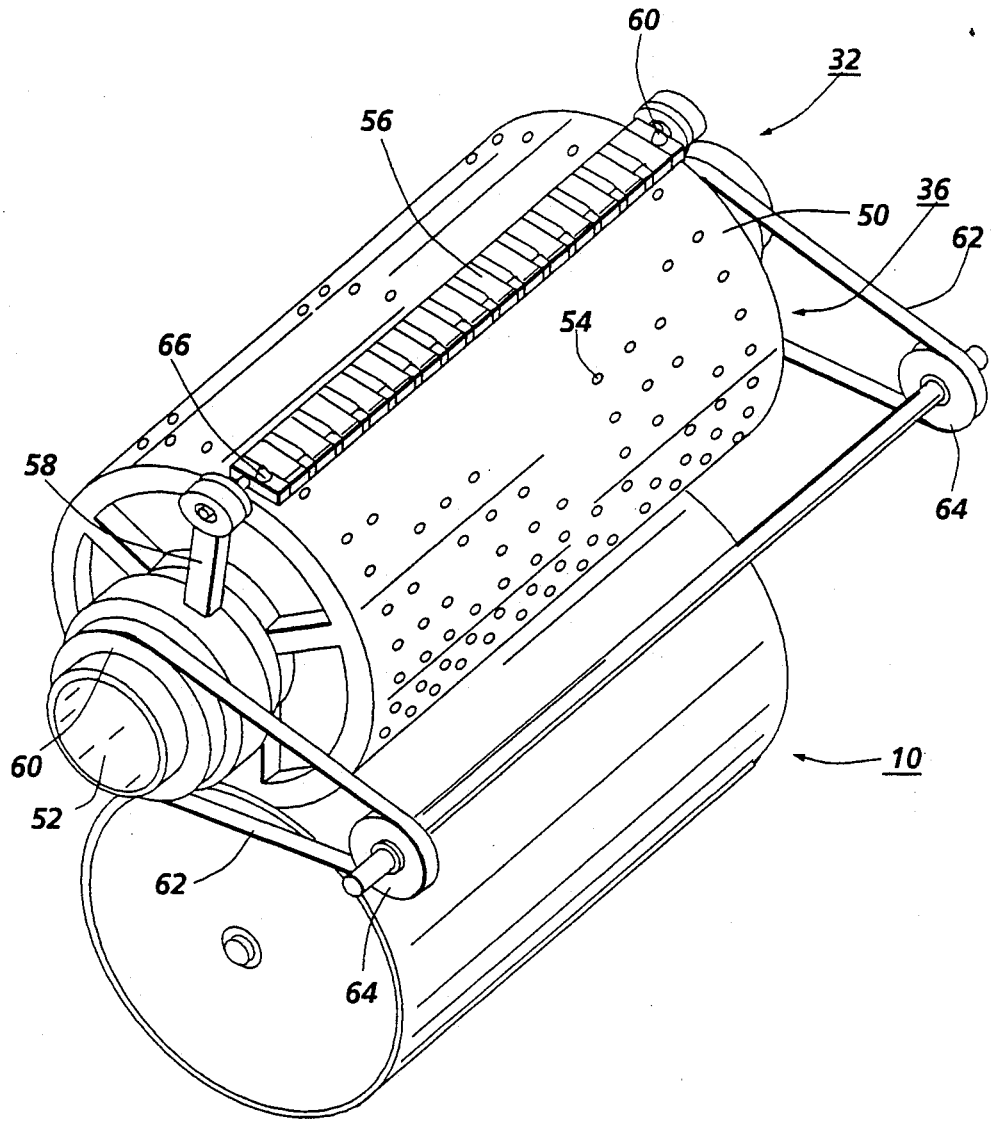
FIG. 2 is a perspective view of the sheet transport and transfer system used in the FIG. 1 printing machine.

Referring now to the specific subject matter of the present invention, FIG. 2 illustrates transfer station D in greater detail. As shown thereat, transfer drum 36 includes a stationary cylinder 50 mounted on a hollow stationary axle 52. Cylinder 50 has a multiplicity of perforations or holes 54 therein. The holes 54 in cylinder 50 are connected via suitable ducts passing through the hollow axle to a vacuum blower. In this way, the pressure at the surface of drum 50 is reduced. Electrical wires and the vacuum supply can be distributed through the hollow axle and applied to cylinder 50 as required, since both are stationary. This causes the story sheet to be vacuum tacked to the exterior surface of cylinder 50 as it is being moved relative thereto by sheet gripper 32 so as to insure that the trailing edge of the sheet does not flip and disturb the toner image as the copy sheet is being recirculated. Sheet gripper 32 includes a gripper bar 56 supported at opposed ends by drive arms 58. Drive arm 58 is mounted on pulley 60. Pulley 60 is mounted rotatably on stationary axle 52. Belt 62 couples pulley 64 to pulley 60. The shaft of pulley 64 is connected to a direct drive motor. In this way, gripper bar 56 rotates relative to cylinder 50 at substantially the same angular velocity as that of drum 10. Registration pins 66 extend outwardly from either end of gripper bar 56. Pins 66 mate with holes in the non-image area of drum 10. This insures that successive toner images are transferred to the copy sheet in superimposed registration with one another. The gripper bar is opened by a cam as it rotates into the sheet feed area. The copy sheet is fed into the gripper bar against a stop. A second cam closes the gripper bar and clamps the copy sheet. The gripper bar pulls the copy sheet around the stationary cylinder. The holes in the cylinder provide a vacuum to hold the copy sheet against the cylinder as the gripper bar drags the copy sheet into the transfer zone. The vacuum also controls trail edge flip.

Figure 3:
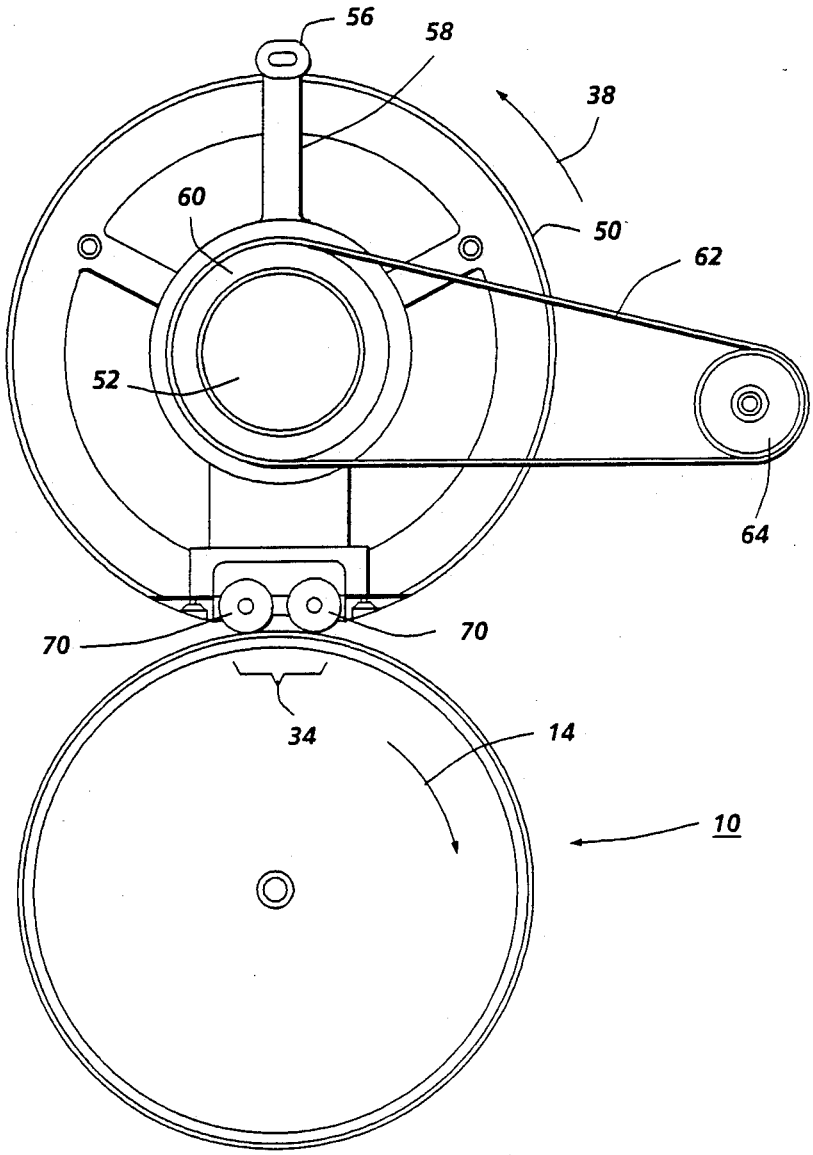
FIG. 3 is an elevational view of one of the FIG. 2 sheet transport and transfer system.

Turning now to FIG. 3, there is shown an elevational view of the sheet transport system and the transfer system. As depicted thereat, a pair of rollers 70 are mounted rotatably on cylinder 50 in transfer zone 34. Rollers 70 are made from an electrically conductive material. These rollers are electrically biased to a suitable magnitude and polarity to attract the toner image from the photoconductive surface of drum 10 to the copy sheet passing through transfer zone 34. As pulley 64 moves belt 62, pulley 60 rotates arm 58 to move gripper bar 56 with the copy sheet secured thereto through a recirculating path about the periphery of cylinder 50. The copy sheet is vacuum tacked to the cylinder. Inasmuch as the cylinder is stationary, the gripper bar 56 drags the copy sheet over the surface of the cylinder. This insures that the trailing edge of the copy sheet does not flip disturbing the toner image transferred thereto.

Figure 4:
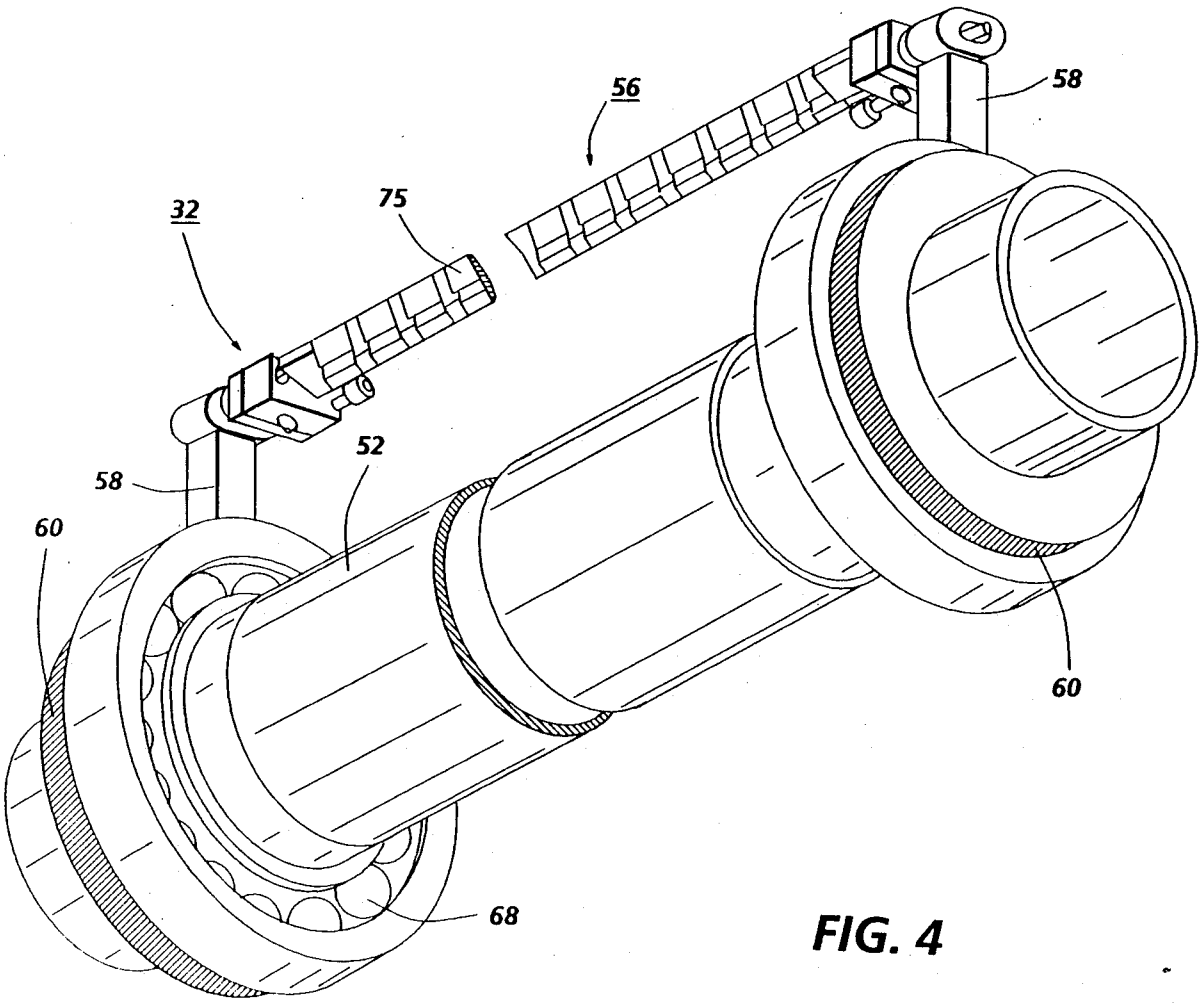
FIG. 4 is a perspective view of the FIG. 2 sheet transport.

Referring now to FIG. 4, there is shown further details of the sheet gripper 32. Gripper bar 56 is mounted, at opposed ends, on drive arms 58 which extend outwardly from pulleys 60. Pulleys 60 are journalled for rotation by being mounted, on opposed ends, on bearings 68. Gripper bar 56 has a plurality of fingers 75 which are mounted pivotably on a rod and held in the closed position by springs. As drive arm 58 rotates gripper bar 56, the fingers engage a first cam which open the fingers to receive the copy sheet. A second cam closes the fingers. The first cam re-opens the fingers when the copy sheet is released from the gripper bar after the requisite number of toner images have been transferred thereto in superimposed registration with one another.

Figure 5:
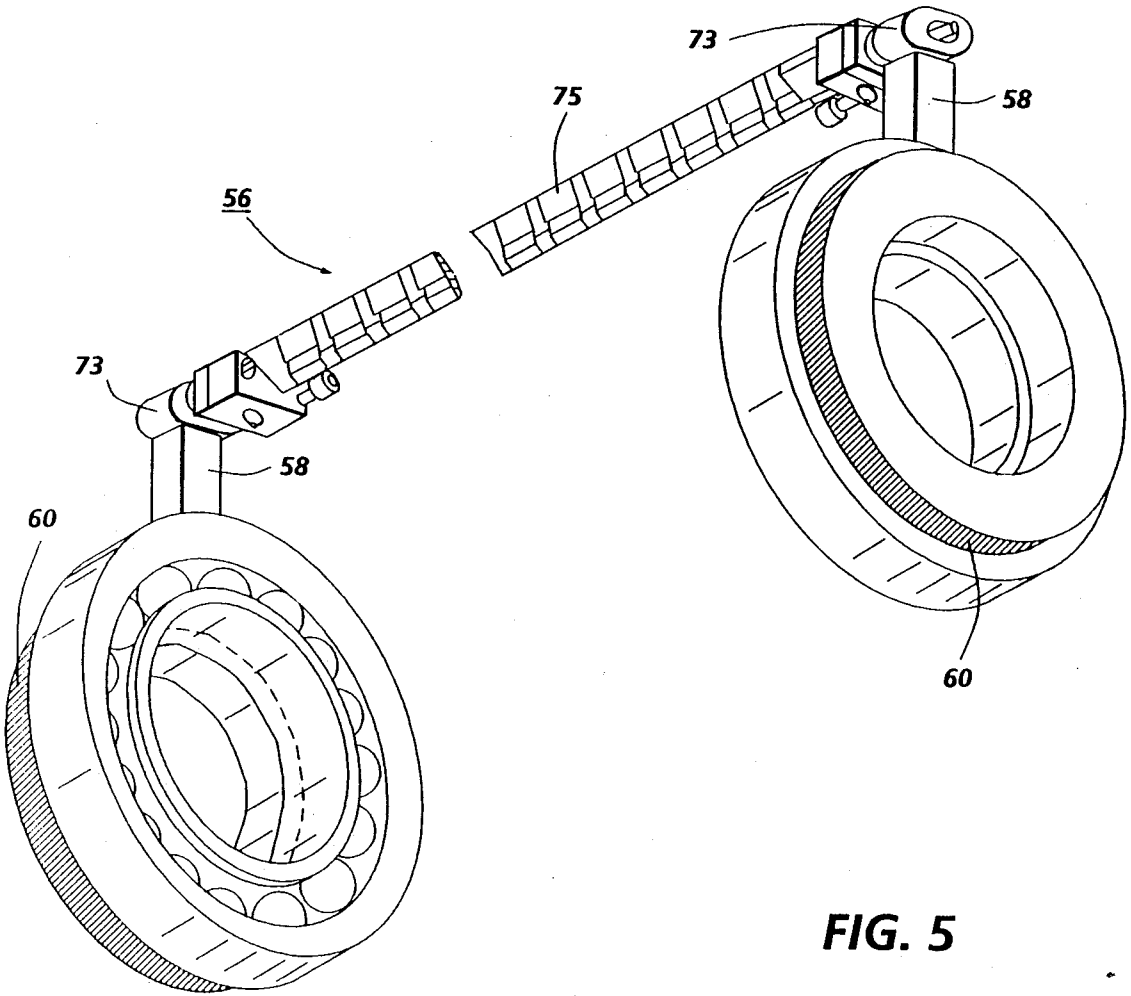
FIG. 5 is a perspective view of the sheet gripper used in the FIG. 4 sheet transport.
Figure 6:
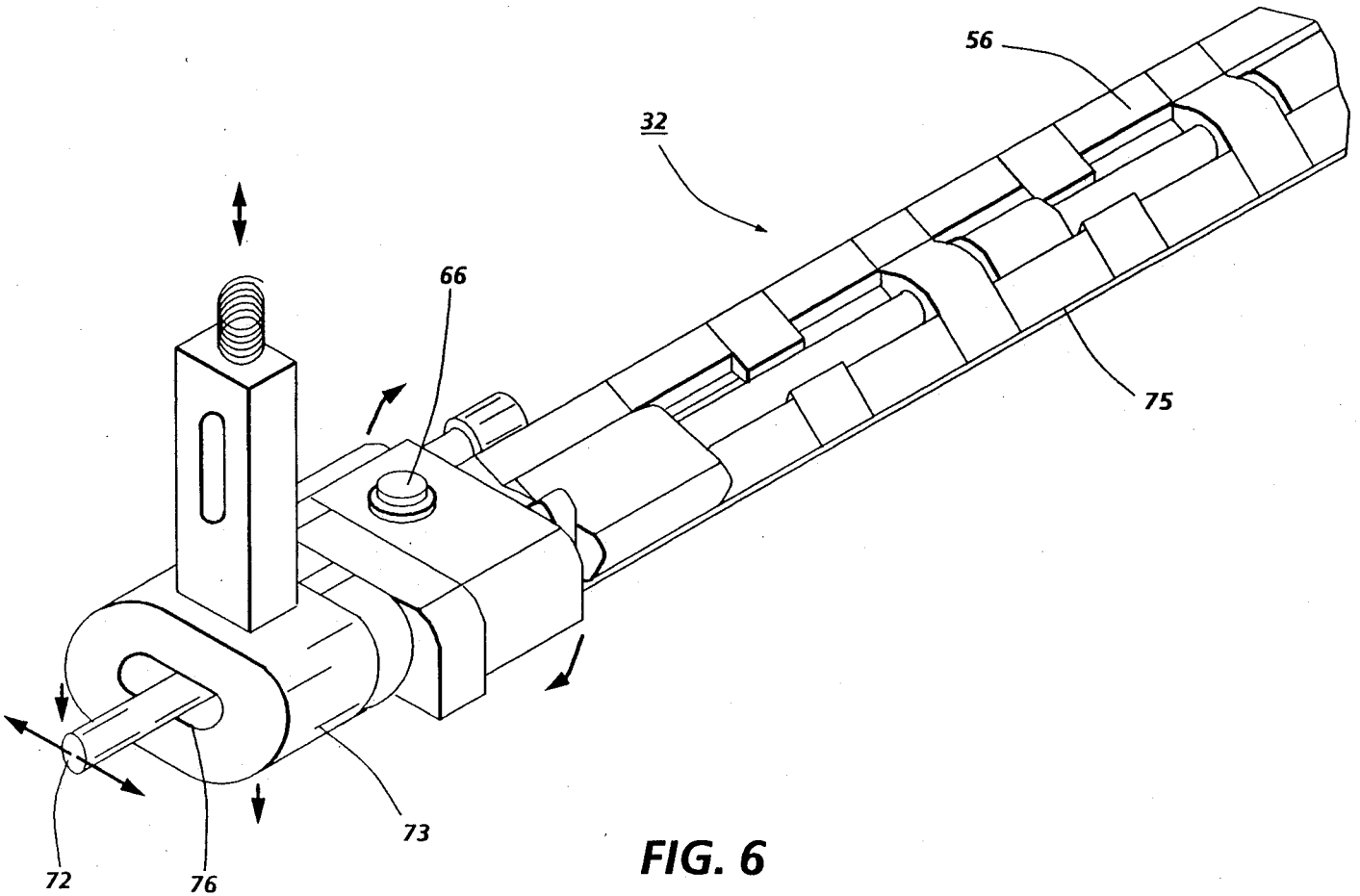
FIG. 6 is a perspective view showing further details of the gripper bar used in the FIG. 5 sheet gripper.

As shown in FIGS. 5 and 6, rod 72 supporting the fingers 75 of gripper bar 56 are mounted in slots 76 of drive arm link 73. Drive arm link 73 is spring loaded in drive arms 58. In this way, the gripper bar is spring loaded and mounted so that its distance from the center of rotation can vary. The radius varies to compensate for changes in the radius required at the transfer zone, i.e. change in the radius of drum 10.

Figure 7:
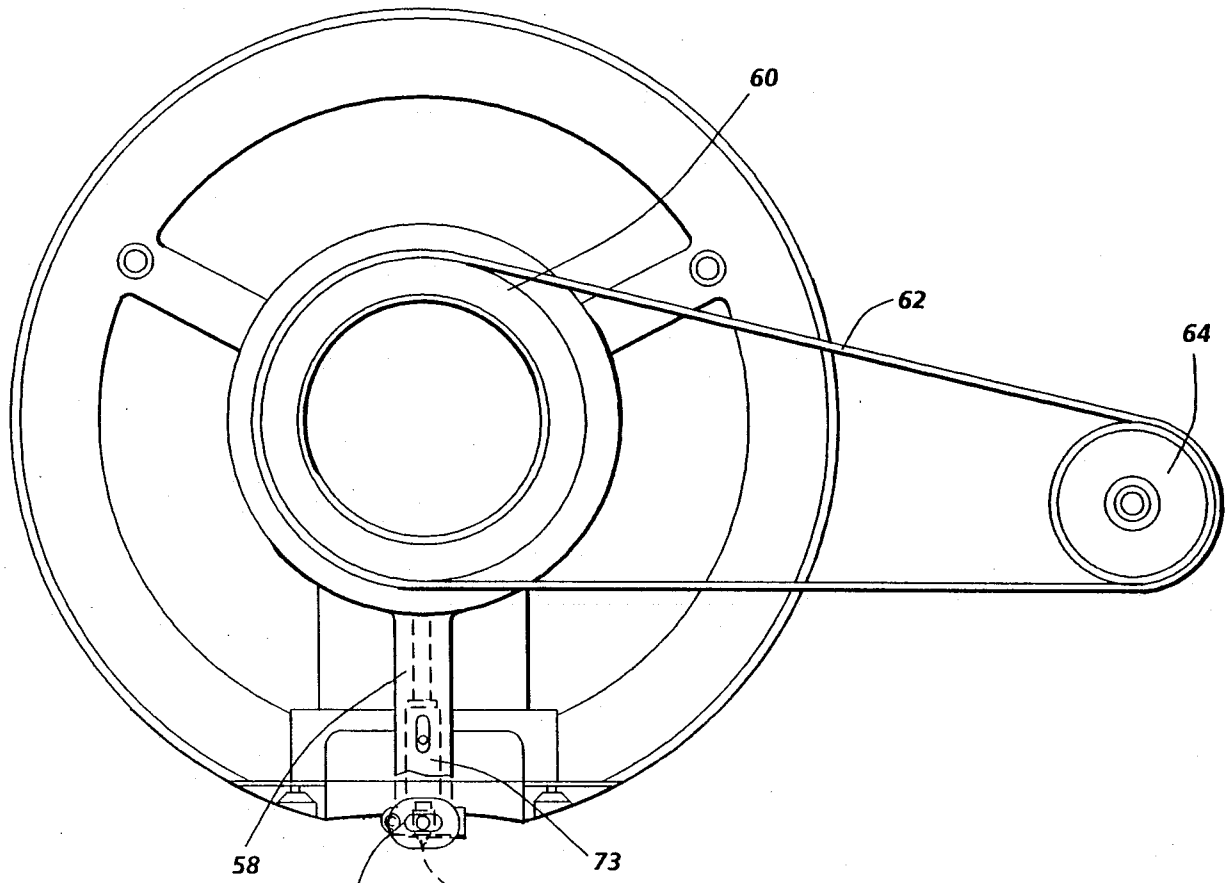
FIG. 7 is an elevational view showing the registration system for the FIG. 2 sheet transport and transfer system.
Figure 8:
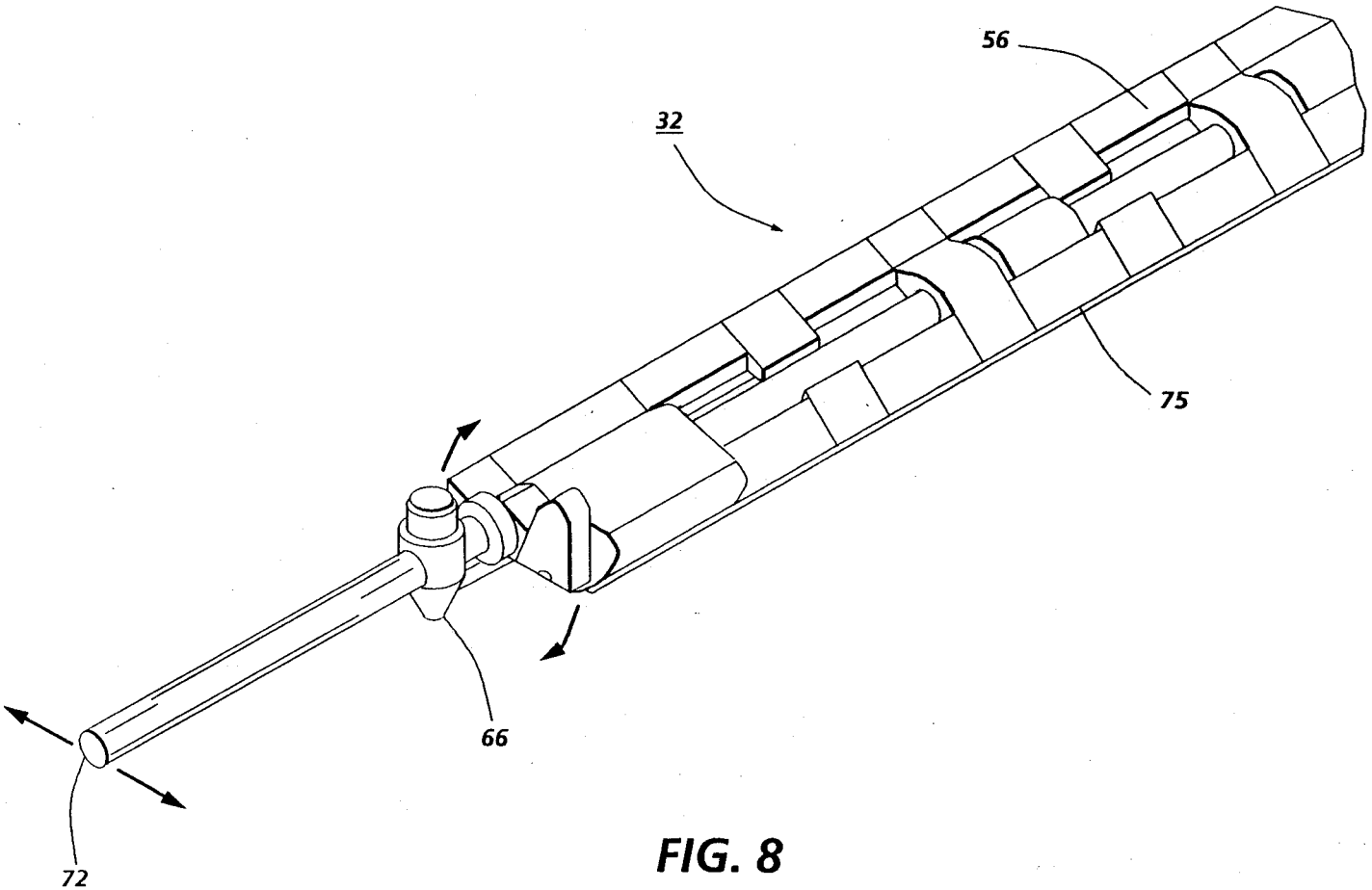
FIG. 8 is a perspective view showing further details of the gripper bar used in the FIG. 5 sheet gripper.
Figure 9:
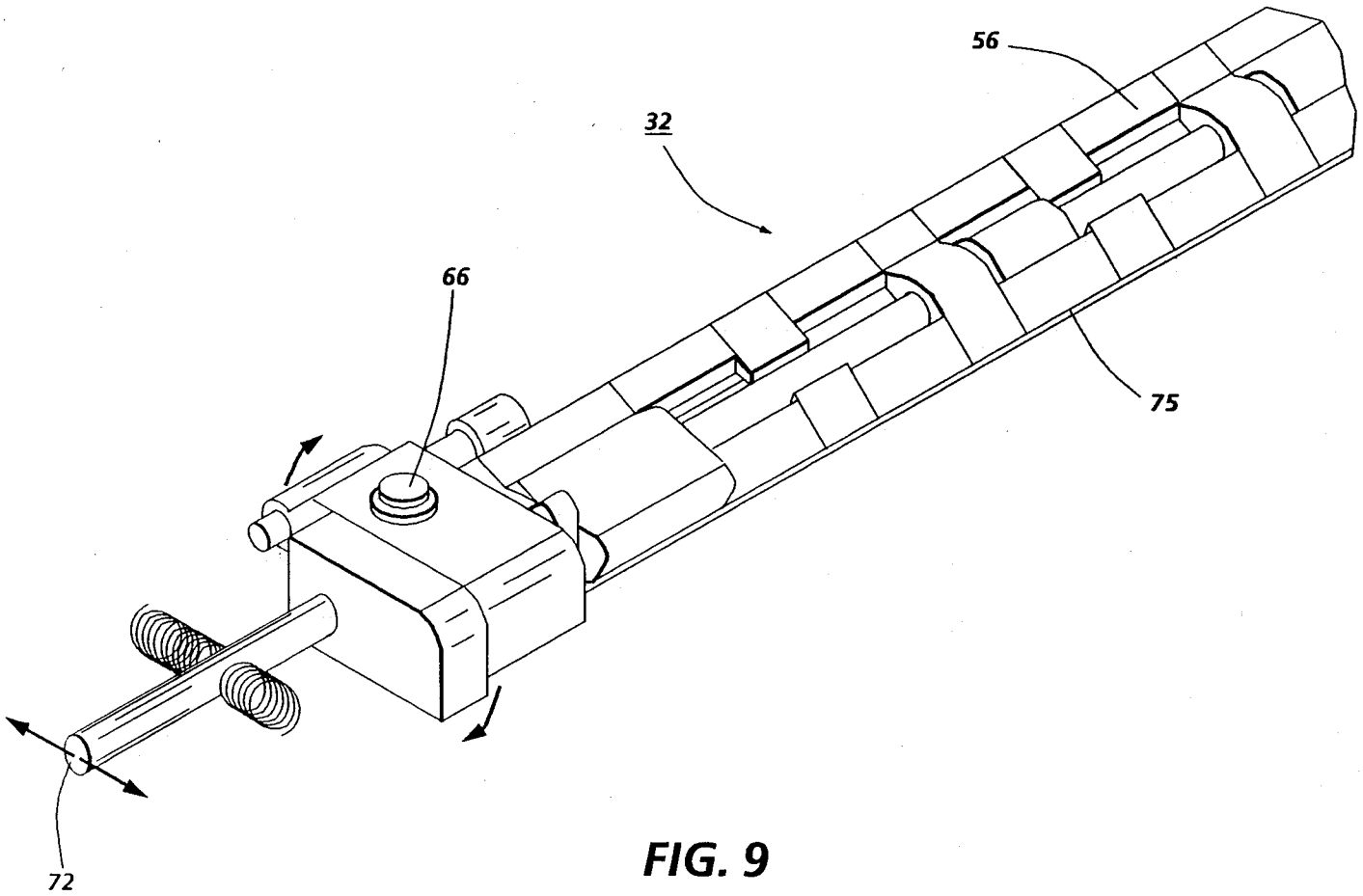
FIG. 9 is a perspective view showing further details of the gripper bar used in the FIG. 5 sheet gripper.

FIGS. 7, 8 and 9 depict registration pins 66 in greater detail. As shown thereat, pin 66 is mounted on rod 72. Rod 72 is loaded between two springs in slot 76 to compensate for the tolerances of the the registration pin. Rod 72 of the gripper bar is mounted on drive arm link 73 in slot 76. There two springs and adjusting screws on either side thereof to center the rod with the arm. This further insures that the registration pins have sufficient movement to compensate for any tolerances or misalignments when mating with the registration holes in photoconductive drum 10. The drive rotating pulley 64 is a servo motor with an encoder. The electronics mate the registration pins with the registration holes in the photoconductive drum, the geometry of the registration pins locate the gripper bar in the same position for each transfer cycle, thereby achieving accurate registration for each toner image being transferred to the copy sheet. The length of the sheet path and the circumference of cylinder 50 are the same as that of drum 10. This resolves many servo timing problems. The drive gear ratio is an integer. This makes encoder phase locking easier. In this way, the small number of moving parts enables the device to be more accurate, reliable and lower in cost than those hereinbefore used.

In recapitulation, the sheet transport system of the present invention recirculates the copy sheet and registers the copy sheet relative to the photoconductive drum to insure that successive toner images are transferred thereto in superimposed registration with one another. The moving copy sheet is vacuum tacked to a cylinder so that the trail edge of the copy sheet is vacuum tacked to a cylinder so that the trail edge of the copy sheet cannot flip upward. This insures that the toner image is not disturbed during the transfer of successive different color toner images to the copy sheet.

It is, therefore, apparent that there has been provided, in accordance with the present invention, a sheet transport system for use in a transfer station that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations that fall within the spirit and scope of the appended claims.

We claim:

1. An apparatus for transporting a sheet through a transfer station to transfer an image from an image receiving member thereto, including:

a stationary transfer member having at least a portion thereof positioned closely adjacent the image receiving member to define a transfer zone therebetween;

means for vacuum tacking a substantial portion of the sheet to said transfer member; and means for moving the sheet relative to said transfer member to advance the sheet through the transfer zone to transfer the image from the receiving member to the sheet.

2. An apparatus according to claim 1, further including means, associated with said moving means, for placing the sheet in registration with the image on the image receiving member.

3. An apparatus according to claim 2, wherein said placing means detachably couples said moving means to the image receiving member with said moving means being decoupled from the image receiving member over a portion of the path of movement to move independently thereof and being coupled thereto over a portion of the the path of movement thereof to place the sheet in registration with image on the image receiving member.

4. An apparatus according to claim 3, wherein said transfer member includes a drum.

5. An apparatus according to claim 4 in which the image receiving member is a photoconductive drum, wherein the diameter of the photoconductive drum is substantially equal to the diameter of said transfer drum.

6. An apparatus according to claim 5, wherein said moving means includes:

a sheet gripper; and means for advancing the sheet gripper about the exterior surface of said transfer drum in a recirculating path of movement.

7. An apparatus according to claim 6, wherein said placing means includes:

a protuberance extending outwardly from said sheet gripper; and an aperture in the photoconductive drum adapted to mesh with the protuberance.

8. An apparatus according to claim 7, further including means for transferring the image from the photoconductive drum to the sheet.

9. An apparatus according to claim 8, wherein said transferring means includes at least one electrically biased roller mounted on said transfer drum in the transfer zone to establish an electrical transfer field for transferring the image from the photoconductive drum to the sheet.

10. An apparatus according to claim 9, wherein said sheet gripper transports the sheet through a recirculating path to transfer a plurality of images, in superimposed registration with one another, from the photoconductive drum to the sheet.

11. An electrophotographic printing machine of the type having a toner image developed on a moving photoconductive member with a sheet being advanced into registration with the toner image developed on the photoconductive member, including:

a stationary transfer member having at least a portion thereof positioned closely adjacent the photoconductive member to define a transfer zone therebetween;

means for vacuum tacking a substantial portion of the sheet to said transfer member; and means for moving the sheet relative to said transfer member to advance the sheet through the transfer zone to transfer the toner image from the photoconductive member to the sheet.

12. A printing machine according to claim 11, further including means, associated with said moving means, for placing the sheet in registration with the toner image on the photoconductive member.

13. A printing machine according to claim 12, wherein said placing means detachably couples said moving means to the photoconductive member with said moving means being decoupled from the photoconductive member over a portion of the path of movement to move independently thereof and being coupled thereto over a portion of the path of movement thereof to place the sheet in registration with the toner image on the photoconductive member.

14. A printing machine according to claim 13, wherein said transfer member includes a drum.

15. A printing machine according to claim 14 in which the photoconductive member is a photoconductive drum, wherein the diameter of the photoconductive drum is substantially equal to the diameter of said transfer drum.

16. A printing machine according to claim 15, wherein said moving means includes:

a sheet gripper; and means for advancing the sheet gripper about the exterior surface of said transfer drum in a recirculating path of movement.

17. A printing machine according to claim 16, wherein said placing means includes:

a protuberance extending outwardly from said sheet gripper; and an aperture in the photoconductive drum adapted to mesh with said protuberance.

18. A printing machine according to claim 17, further including means for transferring the toner image from the photoconductive drum to the sheet.

19. A printing machine according to claim 18, wherein said transferring means includes at least one electrically biased roller mounted on said transfer drum in the transfer zone to establish an electrical transfer field for transferring the toner image from the photoconductive drum to the sheet.

20. A printing machine according to claim 19, wherein said sheet gripper transports the sheet through a recirculating path to transfer a plurality of toner images, in superimposed registration with one another, from the photoconductive drum to the sheet.

* * * * *